US010794142B2

(12) United States Patent
Stone et al.

(10) Patent No.: US 10,794,142 B2
(45) Date of Patent: Oct. 6, 2020

(54) PLUG SEAT WITH ENHANCED FLUID DISTRIBUTION AND SYSTEM

(71) Applicants: Matthew Stone, Humble, TX (US); Michael Johnson, Katy, TX (US); Colin Andrew, Cypress, TX (US); Keith J. Murphy, Hartford, CT (US)

(72) Inventors: Matthew Stone, Humble, TX (US); Michael Johnson, Katy, TX (US); Colin Andrew, Cypress, TX (US); Keith J. Murphy, Hartford, CT (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 134 days.

(21) Appl. No.: 15/969,599

(22) Filed: May 2, 2018

(65) Prior Publication Data

US 2019/0338617 A1 Nov. 7, 2019

(51) Int. Cl.

| | |
|---|---|
| ***E21B 33/12*** | (2006.01) |
| ***E21B 34/14*** | (2006.01) |
| ***E21B 34/06*** | (2006.01) |

(52) U.S. Cl.

CPC ..... *E21B 33/1204* (2013.01); *E21B 34/063* (2013.01); *E21B 34/142* (2020.05)

(58) Field of Classification Search

CPC ..... E21B 34/063; E21B 34/14

See application file for complete search history.

(56) References Cited

U.S. PATENT DOCUMENTS

| | | | | |
|---|---|---|---|---|
| 1,332,333 | A * | 3/1920 | Gregory | E21B 43/12 417/118 |
| 3,096,825 | A * | 7/1963 | Clark, Jr. | E21B 21/10 166/325 |
| 3,878,889 | A * | 4/1975 | Seabourn | E21B 21/103 166/360 |
| 4,842,062 | A * | 6/1989 | Schneider | E21B 33/16 166/154 |
| 5,425,424 | A * | 6/1995 | Reinhardt | E21B 33/16 166/291 |
| 5,553,672 | A * | 9/1996 | Smith, Jr. | E21B 43/10 166/382 |
| 7,954,555 | B2 * | 6/2011 | Ashy | E21B 21/103 166/318 |
| 8,276,675 | B2 * | 10/2012 | Williamson | E21B 21/103 166/306 |
| 8,356,670 | B2 * | 1/2013 | Telfer | E21B 23/006 166/193 |
| 8,668,006 | B2 * | 3/2014 | Xu | E21B 33/12 166/192 |
| 9,121,226 | B2 * | 9/2015 | Mageren | E21B 7/28 |

(Continued)

FOREIGN PATENT DOCUMENTS

| | | | | |
|---|---|---|---|---|
| CA | 2822888 A1 * | 8/2011 | ..... | E21B 34/063 |
| CA | 2799967 A1 * | 6/2013 | ..... | E21B 43/114 |

*Primary Examiner* — Jennifer H Gay

(74) *Attorney, Agent, or Firm* — Cantor Colburn LLP

(57) ABSTRACT

A plug seat including a body having a lead in and a tooth, a flow feature disposed at the body, the feature providing fluid access directly to an area immediately adjacent the tooth. A plug seat including a tooth positioned relative to a body to be at an upstream most end of the body, a cage extending from the body immediately downstream of the tooth to an area radially outward of the tooth and upstream thereof.

15 Claims, 7 Drawing Sheets

(56) References Cited

U.S. PATENT DOCUMENTS 9,121,273 B2 * 9/2015 Norrid ..... E21B 34/14
9,187,994 B2 * 11/2015 Themig ..... E21B 34/103
9,574,414 B2 * 2/2017 Arabsky ..... E21B 34/14
9,593,553 B2 * 3/2017 Larisey ..... E21B 43/26
9,816,351 B2 * 11/2017 Lirette ..... E21B 33/146
10,018,015 B2 * 7/2018 Purkis ..... E21B 33/124
10,246,971 B2 * 4/2019 Doane ..... E21B 34/103
10,370,937 B2 * 8/2019 Pabon ..... E21B 34/14
10,472,927 B2 * 11/2019 Marcin ..... E21B 33/12
2004/0163820 A1 * 8/2004 Bishop ..... E21B 34/06
166/373
2007/0240883 A1 * 10/2007 Telfer ..... E21B 34/14
166/375
2010/0132954 A1 * 6/2010 Telfer ..... E21B 23/006
166/373
2010/0270030 A1 * 10/2010 Ashy ..... E21B 21/103
166/373
2010/0314126 A1 * 12/2010 Kellner ..... E21B 34/14
166/373
2011/0036590 A1 * 2/2011 Williamson ..... E21B 21/103
166/373
2012/0073827 A1 * 3/2012 Kenyon ..... E21B 34/14
166/373
2013/0168099 A1 * 7/2013 Themig ..... E21B 34/103
166/308.1
2013/0180721 A1 * 7/2013 Getzlaf ..... E21B 34/06
166/308.1
2014/0116699 A1 * 5/2014 Helms ..... E21B 23/06
166/285
2014/0138098 A1 * 5/2014 Kellner ..... E21B 34/14
166/373
2014/0151054 A1 * 6/2014 Norrid ..... E21B 34/14
166/318
2014/0166912 A1 * 6/2014 Larisey ..... E21B 43/26
251/61
2015/0083497 A1 * 3/2015 Mageren ..... E21B 7/28
175/57
2015/0136403 A1 * 5/2015 Cheng ..... E21B 43/26
166/308.1
2015/0159469 A1 * 6/2015 Purkis ..... E21B 23/04
166/373
2016/0084040 A1 * 3/2016 Brasseaux ..... E21B 34/10
166/374
2016/0138367 A1 * 5/2016 Lirette ..... E21B 33/146
166/285
2017/0037705 A1 * 2/2017 Pabon ..... E21B 34/14
2017/0089175 A1 * 3/2017 Doane ..... E21B 34/103
2017/0175487 A1 * 6/2017 Marcin ..... E21B 34/10
2018/0223628 A1 * 8/2018 Brandsdal ..... E21B 34/14
2019/0153820 A1 * 5/2019 Lorenson ..... E21B 34/06
2019/0338617 A1 * 11/2019 Stone ..... E21B 34/063

* cited by examiner

PLUG SEAT WITH ENHANCED FLUID DISTRIBUTION AND SYSTEM

BACKGROUND

In the resource recovery industry, there are many actions during which a plug is sent to mate with a seat whereby a pressure differential can be applied. This is done for fracturing operations, tool setting operations, etc. Generally, it is appropriate to remove the plug after the operation is concluded to support other operations including completion or production, etc. For years such plugs were removed by reverse flow or by drilling or milling them away. More recently however, the industry has become interested in dissolvable plugs so that the additional operation of milling or drilling for example can be avoided, thereby saving both time and expense. Dissolvable plugs sometimes take longer to dissolve than intended so the art would well receive advancements that facilitate the dissolution of the plugs at the intended time period.

SUMMARY

A plug seat including a body having a lead in and a tooth, a flow feature disposed at the body, the feature providing fluid access directly to an area immediately adjacent the tooth.

A plug seat including a tooth positioned relative to a body to be at an upstream most end of the body, a cage extending from the body immediately downstream of the tooth to an area radially outward of the tooth and upstream thereof.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
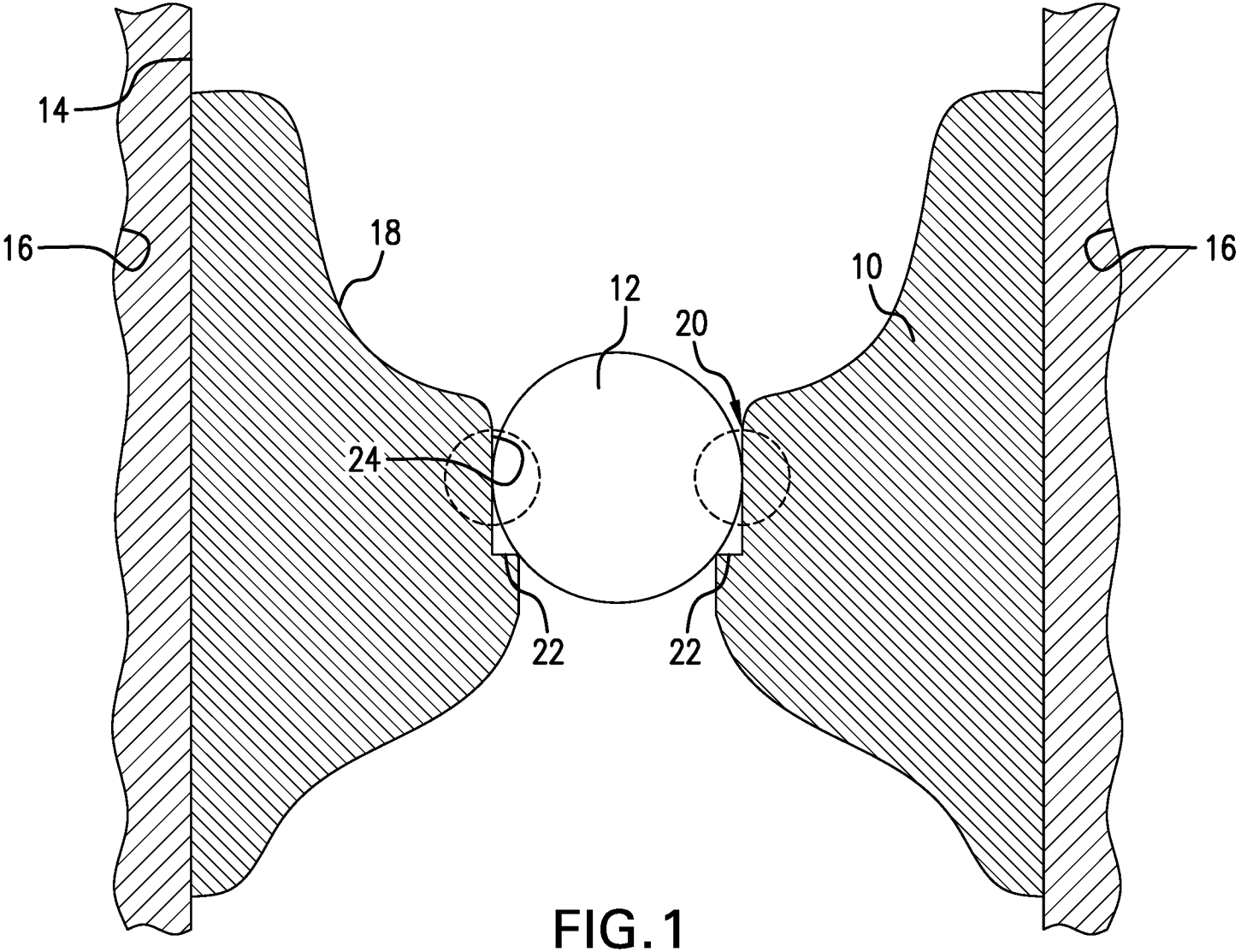
FIG. 1 PRIOR ART
FIG. 1 is a schematic cross sectional view of a prior art plug seat and plug.

Referring to FIG. 1, one of ordinary skill in the resource recovery arts will recognize a schematic cross section of a prior art plug seat 10 with a ball or plug 12 landed therein. It will be appreciated that the seat 10 may be a part of or installed in a tubular 14 such as a casing string in a borehole 16. Commonly in plug seats, there is a lead in frustoconical or frustoparaboloidal portion 18 (sometimes collectively referred to as frusto shaped lead in 18) that may or may not also include a throat 20. The seat 10 will also include a "tooth" 22 upon which the plug 12 will seal, the tooth 22 being either within the throat 20 or in the absence of a throat, at the smallest portion of the frusto shaped lead in 18. In either of these configurations the plug 12 is disposed in close proximity to a surface 24 of the throat 20 or of the frusto shaped lead in 18. The area of close proximity will be termed a gap 26 herein for ease of discussion. For degradable plugs, the proximity is problematic due to corrosion bridging the gap 26 and reducing access to the plug 12 by fluid that is intended to degrade the plug 12. Accordingly, the embodiments below all include a flow feature that encourages fluid access to a portion of the plug 12 immediately adjacent the tooth 22 (upstream and/or downstream of the tooth 22) in order to ensure dissolving fluid will bypass corrosion bridges in the gap 26, thereby enhancing degradation of the plug (it is noted that the terms degradable, dissolvable, corrodible, disintegrable, etc. are terms meant to be associated with the plug going away in a selected period of time based upon a chemical action and the terms are used interchangeably herein).

Figure 2:
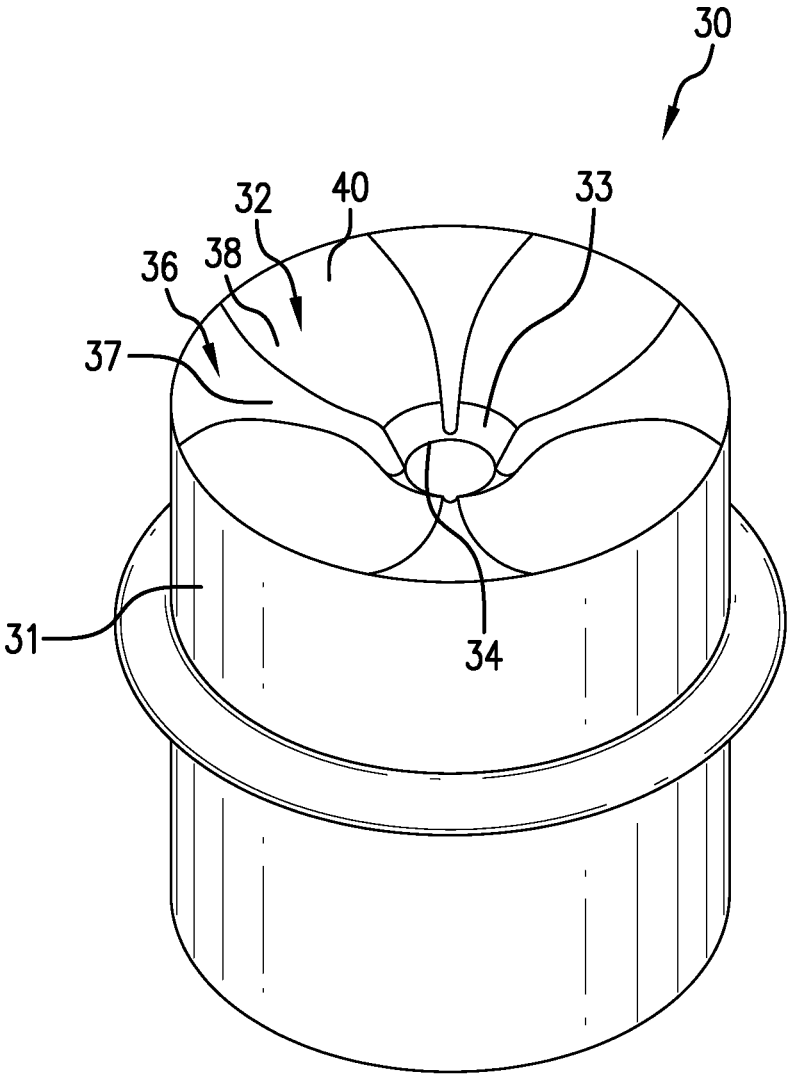
FIG. 2 is a schematic perspective view of a first embodiment of a seat in accordance with the teaching herein.

Referring to FIG. 2, a plug seat 30 is illustrated apart from a casing and without a plug, though it will be appreciated that the seat 30 could be employed with such components and positioned as the seat in FIG. 1 relative to the other components shown in FIG. 1. It is to be understood that the seat 30 is positionable in or as a part of a tubular form such as a sleeve, a string, etc. Seat 30 includes a body 31 having a frusto shape lead in 32, a throat 33 and a tooth 34 disposed within the throat 33 to receive a plug in generally sealing contact therewith when a plug is deployed (similar to as illustrated in FIG. 1). Further, seat 30 includes a flow feature 36 such as a groove 37 in a surface 38 of the frusto shaped lead in 32. There may be any number of grooves 37 as can practically be created in the surface 38 with four illustrated in FIG. 2. The groove 37 is cut into or formed (cast, additively manufactured, etc.) in the surface 38 leaving intergroove portions 40 of the surface 38 proud of the groove 37. The groove(s) 37 provide a flow path for fluid to reach an area of a seated plug (not shown) immediately adjacent (i.e. within a few millimeters) the tooth 34 so that dissolution fluid will bypass a gap area and degradation of the plug will occur in the area near the tooth 34. Further, it is to be noted that the groove 37 as illustrated is trumpet shaped but this is not intended to be limiting, rather other shapes are also contemplated.

In related embodiments, the groove 37 may be textured or knurled to increase the ability of fluids to penetrate under a proppant or precipitant created around the ball seat area. It has been noted that magnesium hydroxide precipitants are 2 to 6 microns in size, adding a surface texture with 2 to 3 times this diameter would provide a pathway for flow to continue disintegration of the seat plug. For example, if the precipitate particle size is 2 microns, the texture may be 4-6 microns; and if the precipitate particle size is 4 microns, the texture may be 8 to 12 microns. Different plugging materials may result in different particle sizes and hence the texture sizes would be selected based upon the particle size but the ratios noted above would be used.

Figure 3:
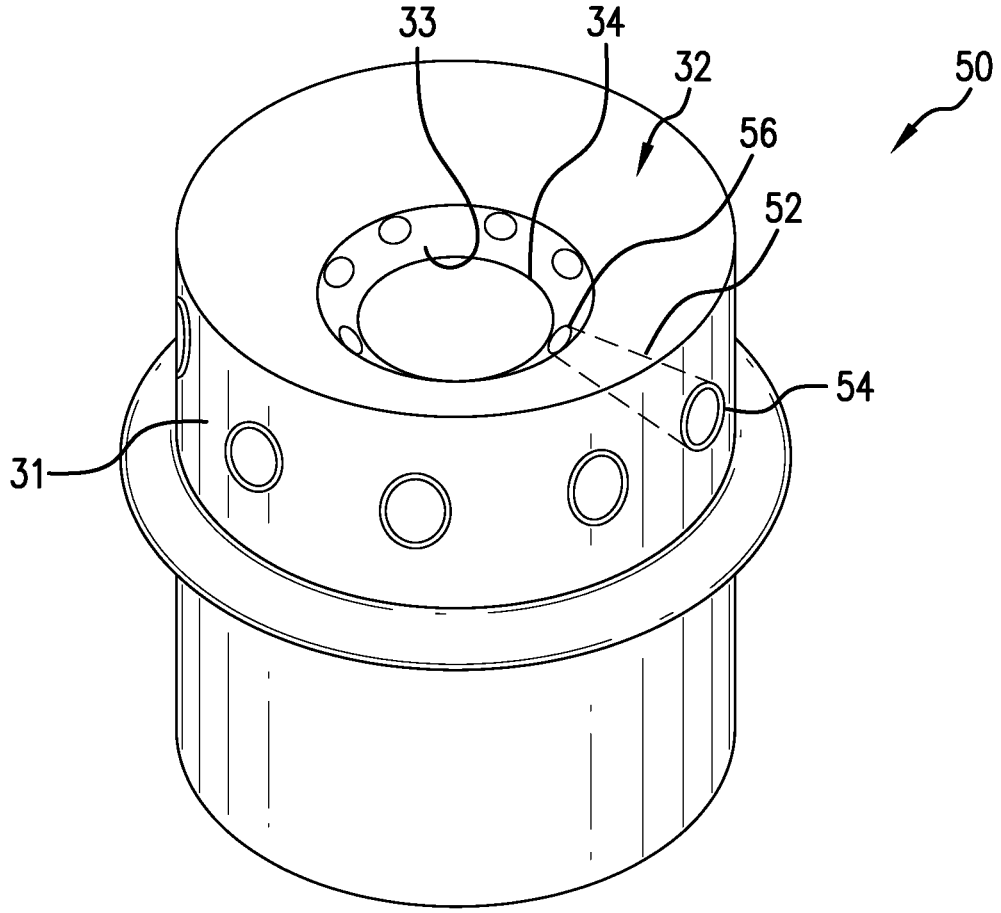
FIG. 3 is a schematic perspective view of another embodiment of a seat in accordance with the teaching herein.

Referring to FIG. 3, another embodiment of a seat 50 is illustrated apart from a casing and without a plug, though it will be appreciated that the seat 50 could be employed with such components and positioned as the seat in FIG. 1 relative to the other components shown in FIG. 1. It is to be understood that the seat 50 is positionable in or as a part of a tubular form such as a sleeve, a string, etc. Seat 50 includes a body 31 and a frusto shaped lead in 32, a throat 33 and tooth 34, which is disposed in the throat 53. The seat 50 further includes a flow feature 36 such as a pathway 52 extending through a body 31 of the seat 50 from an opening 54 to a port 56. The pathway 52 acts to allow fluid to move through the body 31 from a radially outward position, through opening 54 to port 56 immediately adjacent and just upstream of the tooth 56 thereby supplying degrading fluid to a degradable or dissolvable plug (not shown) sealed to the tooth in order to degrade the same and encourage its departure from the tooth to reopen flow through the seat 50 at the intended time. Any number of pathways 52 may be used limited only by the practicality of forming the pathways through the body 31. Several pathways 52 are illustrated in FIG. 3.

Figure 4A:
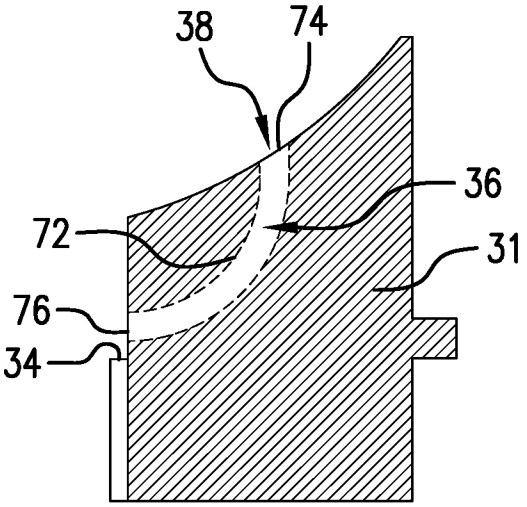
FIG. 4*a* is a quarter section view of FIG. 4.
Figure 4:
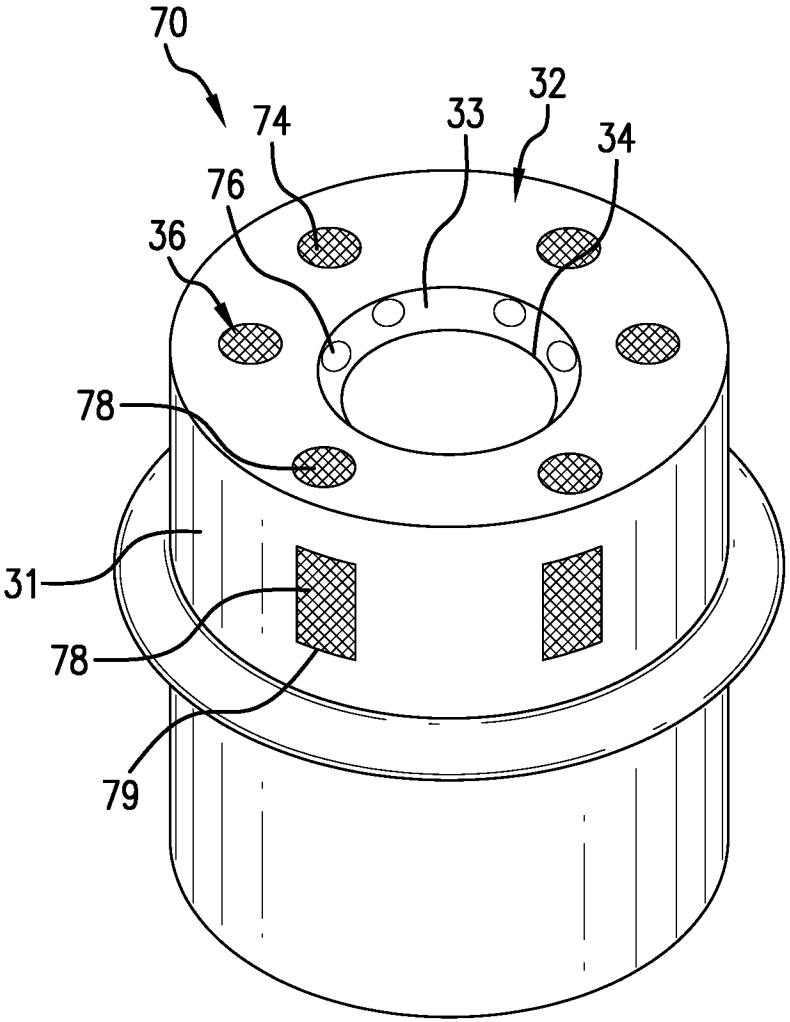
FIG. 4 is a schematic perspective view of another embodiment of a seat in accordance with the teaching herein.
Figure 4B:
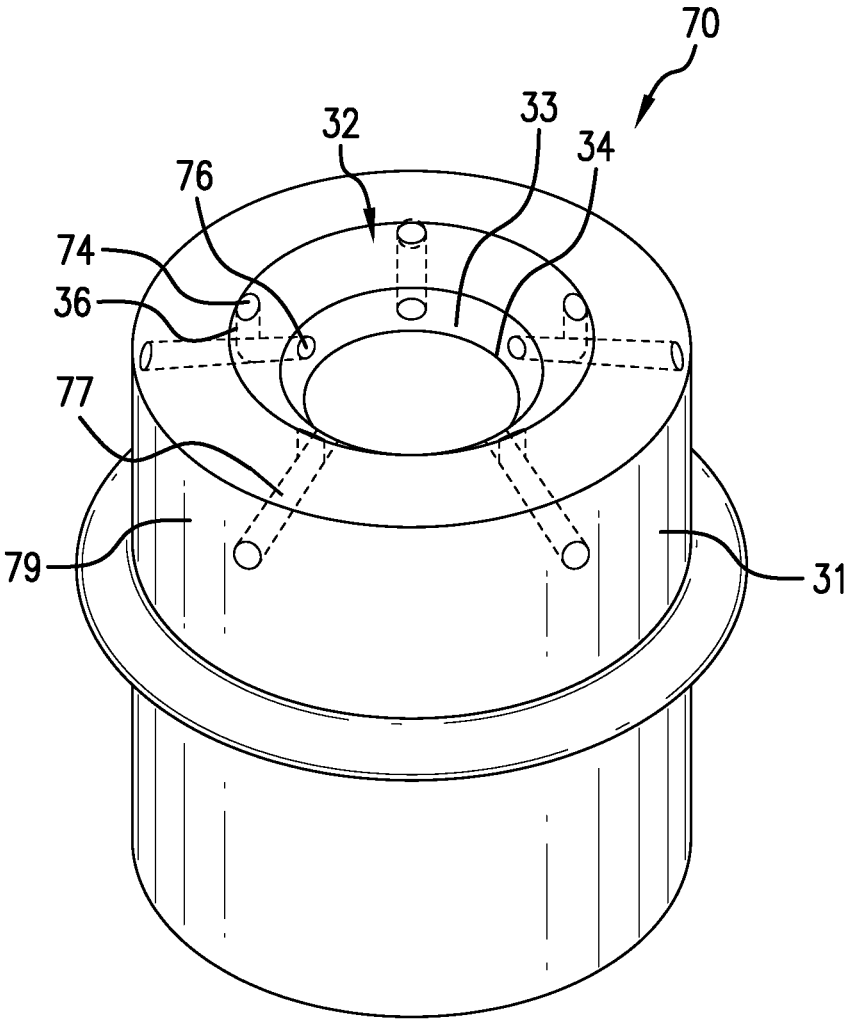
FIG. 4*b* is a schematic perspective view of another embodiment of a seat in accordance with the teaching herein.

Referring to FIGS. 4, 4*a* and 4*b* simultaneously, another embodiment of a seat 70 is illustrated apart from a casing and without a plug, though it will be appreciated that the seat 70 could be employed with such components and positioned as the seat in FIG. 1 relative to the other components shown in FIG. 1. It is to be understood that the seat 70 is positionable in or as a part of a tubular form such as a sleeve, a string, etc. Seat 70 is similar to the embodiment of FIG. 3 in that seat 70 includes a body 31 and a frusto shaped lead in 32, a throat 33 and tooth 34, which is disposed in the throat 53. The seat 70 further includes a flow feature 36 such as a pathway 72 extending through a body 31 of the seat 70 from an opening 74 to a port 76. The pathway 72 acts to allow fluid to move through the body 31 from a position at the surface 38 of the lead in 32, through opening 74 to port 76 immediately adjacent and just upstream of the tooth 34 thereby supplying degrading fluid to a degradable or dissolvable plug (not shown) sealed to the tooth in order to degrade the same and encourage its departure from the tooth 34 to reopen flow through the seat 70 at the intended time. It is to be understood that the pathway 72 may be curved as shown in FIG. 4*a* created by casting or Additive Manufacturing methods or may be created by intersecting boreholes 77 (see FIG. 4*b*) created in a subtractive machining method for example. It is also noted that in some iterations, it may be desirable to include screens 78 at opening 74 and/or port 76 or intersect port 79. Any number of pathways 72 may be used limited only by the practicality of forming the pathways through the body 31. Several pathways 72 are illustrated in FIG. 3.

Figure 5:
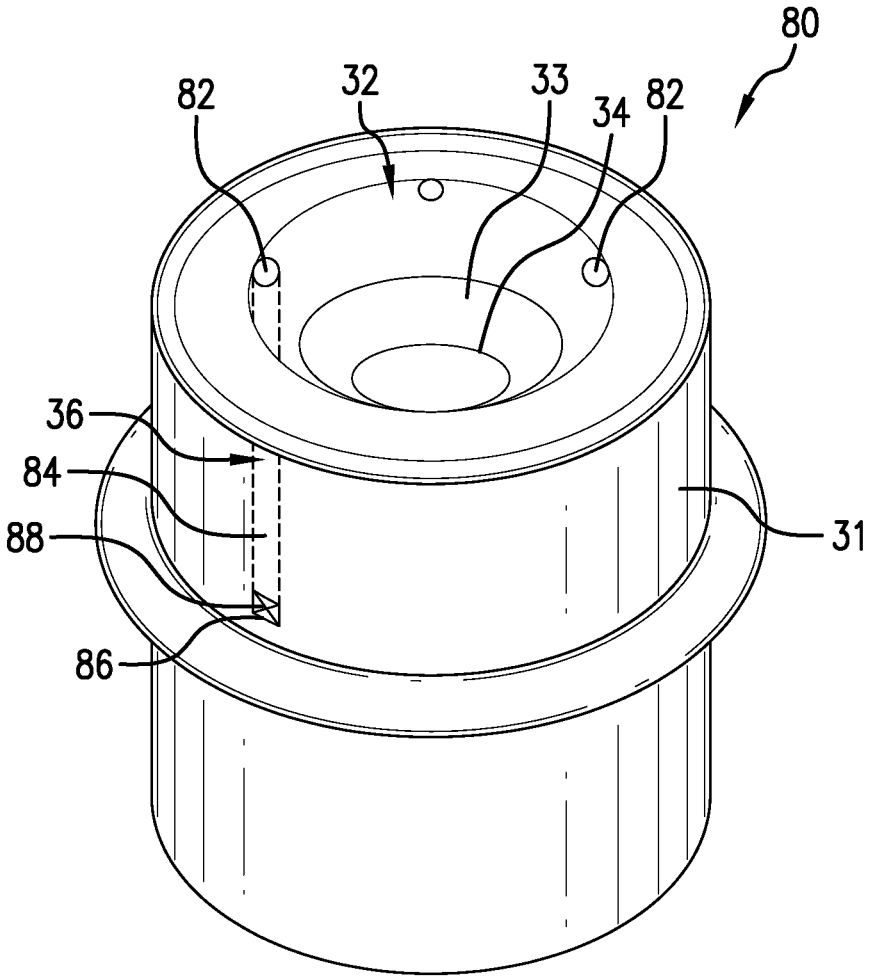
FIG. 5 is a schematic perspective view of another embodiment of a seat in accordance with the teaching herein.

FIG. 5 illustrates another embodiment where a seat 80 is similar to seat 70 in FIG. 4 including body 31, lead in 32, throat 33 tooth 34, etc. and overall the functional attributes of the seat 80 are similar to those above but the flow feature has altered function. The flow feature 36 of seat 80 communicates a volume upstream of the seat 80 to a volume downstream of the seat 80. Specifically, seat 80 includes a flow feature 36 comprising openings 82 that are set in a lead in 32 but these openings 82 lead to a passage 84 which extends to an outlet 86 that is initially plugged with a degradable closure 88. Outlet 86 is fluidly communicated to a volume that is downstream of the seat 80 and is segregated from a volume upstream of the seat 80 when a plug (i.e. one like plug 12) is seated on the tooth 34. These volumes remain segregated while the plug 12 remains on tooth 34 in an undegraded condition until the closure 88 degrades and allows fluid communication around the plug 12. It is possible that the plug 12 will degrade in a timely manner and the flow feature 36 would not need to come into play but if a gap as discussed above becomes occluded with corrosion products from a plug seated in the throat 33, then the closure 88 may open first thereby allowing dissolution fluid to reach a downstream surface of the plug 12 to improve the degradation of the plug 12 and speed removal thereof.

Figure 6:
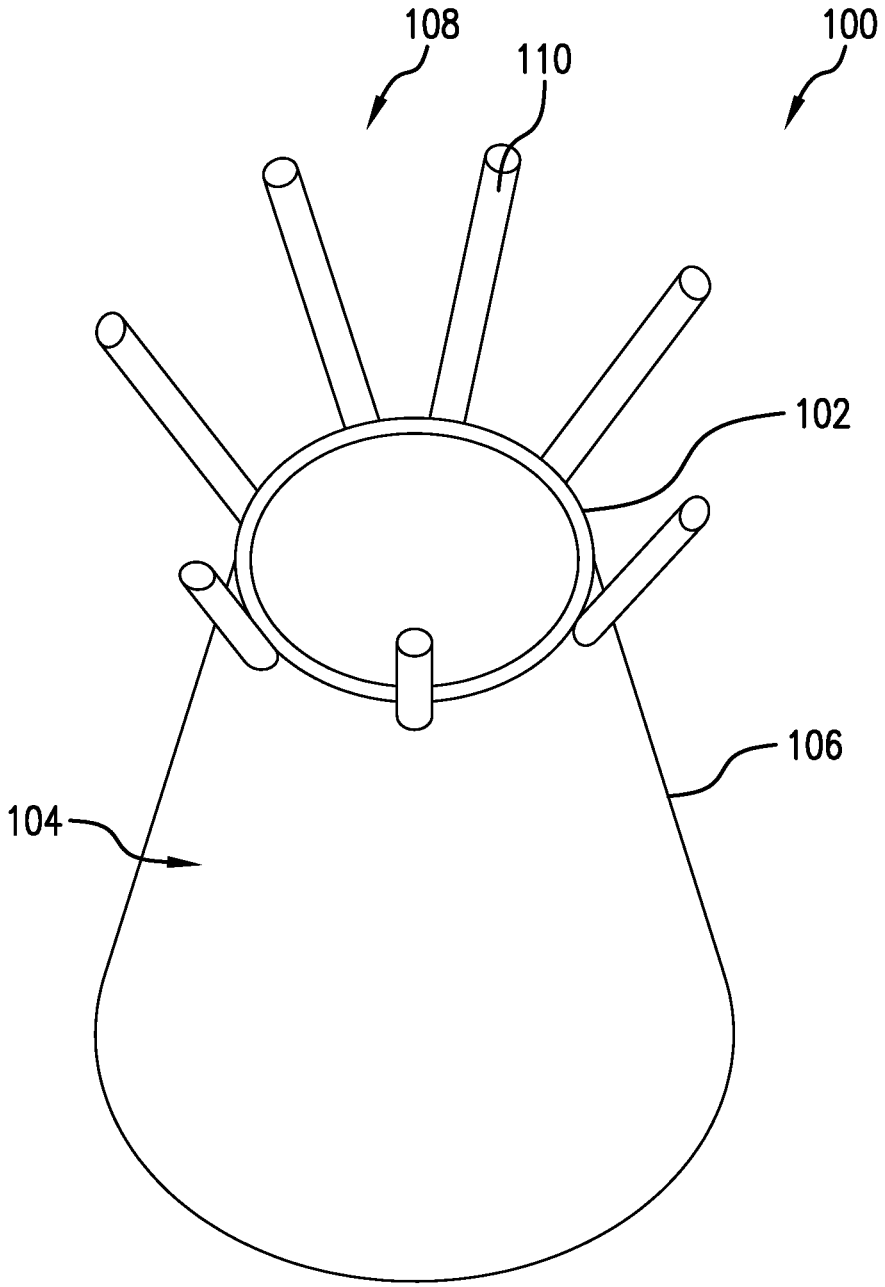
FIG. 6 is a schematic perspective view of another embodiment of a seat in accordance with the teaching herein.

In yet another embodiment, referring to FIG. 6, a seat 100 is illustrated apart from a casing and without a plug, though it will be appreciated that the seat 100 could be employed with such components and positioned as the seat in FIG. 1 relative to the other components shown in FIG. 1. It is to be understood that the seat 100 is positionable in or as a part of a tubular form such as a sleeve, a string, etc. Seat 100 presents a tooth 102 at an upstream end of the seat 100 rather than near a downstream end of the seat as the foregoing embodiments do. In other words, a seat body 104 is inverted from other embodiments herein with a frustoconical structure 106 extending downstream from the tooth 102. One of ordinary skill in the art might rightly question how a plug (not shown) would land and seal at the tooth 102 with the inverted form of the body 104 without missing but this is addressed with a cage 108 comprising a number of arms 110 (7 shown but more or fewer may be substituted). The arms 110 extend from just downstream of the tooth 102 in an upstream direction and outwardly. When disposed in a tubular (casing, sleeve, etc.), the arms 110 extend into close proximity with the tubular in which the seat 100 is disposed or forms a part. Accordingly, the plug will be directed by the cage 108 toward the tooth 102 and seat and seal there. Due to the construction however, there is very little area around the plug where there is the gap discussed with reference to FIG. 1. Rather, there is mostly open space about the plug that allows fluid to access the plug at almost all of its surface area above the tooth 102 resulting in timely degradation of the plug. The arms 110 may be constructed of cylindrical or square or rectangular or triangular shaped material for example but any cross sectional shape for arms 110 may be employed.

It is to be understood that combinations of the features of each of the embodiments hereof are contemplated and within the scope of the invention.

Set forth below are some embodiments of the foregoing disclosure:

Embodiment 1: A plug seat including a body having a lead in and a tooth, a flow feature disposed at the body, the feature providing fluid access directly to an area immediately adjacent the tooth.

Embodiment 2: The plug seat as in any prior embodiment, wherein the flow feature is a groove.

Embodiment 3: The plug seat as in any prior embodiment, wherein the groove is textured.

Embodiment 4: The plug seat as in any prior embodiment, wherein the flow feature includes a screen.

Embodiment 5: The plug seat as in any prior embodiment, wherein the groove is trumpet shaped.

Embodiment 6: The plug seat as in any prior embodiment, wherein the flow feature is a pathway.

Embodiment 7: The plug seat as in any prior embodiment, wherein the pathway includes an opening at a lead in of the body.

Embodiment 8: The plug seat as in any prior embodiment, wherein the pathway includes a port.

Embodiment 9: The plug seat as in any prior embodiment, wherein the port is disposed immediately adjacent the tooth.

Embodiment 10: The plug seat as in any prior embodiment, wherein the port is upstream of the tooth during use.

Embodiment 11: The plug seat as in any prior embodiment, wherein the flow feature is a passage.

Embodiment 12: The plug seat as in any prior embodiment, wherein the passage intersects a pathway.

Embodiment 13: The plug seat as in any prior embodiment, wherein the passage includes a closure.

Embodiment 14: The plug seat as in any prior embodiment, wherein the closure is downstream of the tooth during use.

Embodiment 15: The plug seat as in any prior embodiment, wherein the closure is degradable.

Embodiment 16: The plug seat as in any prior embodiment, wherein the passage includes an opening on an outer periphery of the body.

Embodiment 17: A plug seat including a tooth positioned relative to a body to be at an upstream most end of the body, a cage extending from the body immediately downstream of the tooth to an area radially outward of the tooth and upstream thereof.

Embodiment 18: The plug seat as in any prior embodiment, wherein the cage comprises a number of arms.

Embodiment 19: The plug seat as in any prior embodiment, wherein the cage comprises extend from the body to a position proximate a tubular in which the body is disposed.

Embodiment 20: The plug seat as in any prior embodiment, wherein the arms have a cylindrical cross section.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A plug seat comprising:

a body having a lead in and a tooth configured to make a full seal against a plug during use, the body having a surface disposed immediately adjacent the tooth, the surface and the plug defining a gap therebetween;

a pathway defined through the body and being enclosed by the body other than at an opening at one end of the pathway and a port at another end of the pathway, the port being disposed between the lead in and the tooth and immediately adjacent the tooth, the pathway providing fluid access directly to the surface immediately adjacent the tooth.

2. The plug seat as claimed in claim 1 wherein the pathway includes a screen.

3. The plug seat as claimed in claim 1 wherein the pathway opening is disposed on an outer periphery of the body.

4. The plug seat as claimed in claim 1 wherein the pathway includes an opening at the lead in of the body.

5. The plug seat as claimed in claim 1 wherein the port is upstream of the tooth during use.

6. The plug seat as claimed in claim 1 wherein the body includes a passage.

7. The plug seat as claimed in claim 6 wherein the passage intersects the pathway.

8. The plug seat as claimed in claim 6 wherein the passage includes a closure.

9. The plug seat as claimed in claim 8 wherein the closure is downstream of the tooth during use.

10. The plug seat as claimed in claim 8 wherein the closure is degradable.

11. The plug seat as claimed in claim 6 wherein the passage includes an opening on an outer periphery of the body.

12. A plug seat comprising:

a tooth positioned relative to a body to be at an upstream most end of the body;

an open cage extending from the body immediately upstream of the tooth, wherein an entire length of the open cage extends radially outward of the tooth and upstream thereof.

13. The plug seat as claimed in claim 12 wherein the cage comprises a number of arms.

14. The plug seat as claimed in claim 13 wherein the arms have a cylindrical cross section.

15. The plug seat as claimed in claim 12 wherein the number of arms extend from the body to a position proximate a tubular in which the body is disposed.

* * * * *